US005344235A

United States Patent [19]

Weetman et al.

[11] Patent Number: 5,344,235

[45] Date of Patent: Sep. 6, 1994

[54] EROSION RESISTANT MIXING IMPELLER

[75] Inventors: Ronald J. Weetman, Rochester; Frederick W. Kehr, III, Webster; Thomas A. Taylor, Caledonia; Jonathan C. Everdyke, Canandaigua, all of N.Y.

[73] Assignee: General Signal Corp., Rochester, N.Y.

[21] Appl. No.: 6,552

[22] Filed: Jan. 21, 1993

[51] Int. Cl.[5] ..... B01F 5/12

[52] U.S. Cl. ..... 366/270; 366/330; 416/236 A

[58] Field of Search ..... 366/262, 263, 265, 270, 366/330, 331, 343; 416/241 R, 233, 237, 236 R, 236 A, 241 A

[56] References Cited

U.S. PATENT DOCUMENTS

| | | | |
|---|---|---|---|
| 2,652,897 | 9/1953 | Le Compte | 416/233 |
| 3,566,493 | 3/1971 | Poucher et al. | 416/233 |
| 3,606,580 | 9/1971 | Kaufman, Sr. | 416/233 |
| 4,147,437 | 4/1979 | Jongueres | 366/343 |
| 4,318,672 | 3/1982 | Hansen | 416/241 R |
| 4,492,522 | 1/1985 | Rossmann et al. | 416/241 R |
| 4,571,090 | 2/1986 | Weetman et al. | 366/270 |
| 4,721,394 | 1/1988 | Casto et al. | 366/343 |
| 4,722,608 | 2/1988 | Salzman et al. | 366/270 |
| 4,802,771 | 2/1989 | Weetman | 366/270 |
| 4,808,055 | 2/1989 | Wertz | 416/224 |
| 4,941,750 | 1/1990 | Bouchez | 366/147 |
| 4,988,303 | 1/1991 | Thomas | 366/331 |
| 5,052,892 | 10/1991 | Fasano | 416/204 |
| 5,123,814 | 6/1992 | Burdick et al. | 416/241 A |
| 5,152,606 | 10/1992 | Borraccia et al. | 366/270 |

*Primary Examiner*—Timothy F. Simone
*Assistant Examiner*—James F. Hook
*Attorney, Agent, or Firm*—M. Lukacher

[57] ABSTRACT

In order to extend the life of mixing impellers which circulate materials, and particularly which suspend solids, in the form of particles which erode the blades of the impellers and place a practical limit on impeller speed and/or angle of attack due to increased erosion at high flow velocity (erosion being a function of the cube of the velocity), the blades are constructed from blades into an airfoil configuration which does not limit the thickness of the plates and thereby allows the use of thick plates having extended life. An erosion resistant layer is located at least over the leading edge region of the blade and the shape of the blade reduces velocity of flow over the leading edge; the camber of the blade being maximized midway between the leading and trailing edge. The suction surface of the blade in the region subject to erosion is continuous thereby avoiding discontinuities which form vortices which enhance erosion. Fins, which may be at the tip on the suction side of the blade from midway between the leading and trailing edges to the trailing edge reduces tip vortices thereby further extending blade life in erosion-producing environments.

26 Claims, 5 Drawing Sheets

EROSION RESISTANT MIXING IMPELLER

DESCRIPTION

The present invention relates to mixing and circulating impellers, and particularly to such impellers which are erosion resistant and have extended life when used in erosion-producing environments.

Erosion resistant impellers in accordance with the invention are especially suitable for use in suspending particles in a tank so as to promote chemical reactions which form the particles as crystallites; such crystallites subjecting the blades of the impeller to erosion encountered both by impact of the particles and by sliding of the particles over the impeller surfaces.

FIGS. 1 and 2 show the top and tip of an impeller blade in an erosion-producing environment such as produce by particles in a flow stream indicated by lines at the leading edge 10 of the blade. The blade is an airfoil having a pressure surface 12 and a suction surface 14 where the flow velocity is higher than the pressure surface thereby causing lift and enabling fluid to be pumped downwardly in a direction along the axis of rotation away from the pressure surface 12. The angle of attack of the blade, which is the angle between the chord (a line between the leading edge 10 and the trailing edge 16) to the flow is an acute angle, for example, about 10°. This angle, the blade shape and the speed of the blade determines the flow velocity. It is desirable to produce maximum flow velocity for the power which drives (rotates) the impeller as to maximize the efficiency and reduce the speed of rotation. Erosion is a limitation on efficiency since it limits velocity. There is a trade off between efficiency and velocity and the lifetime of the impeller. This is because of erosion. Erosion varies as the cube of the velocity. FIG. 3 is a plot of a mixing impeller, a large 127 inch diameter impeller was the basis of the data shown in FIG. 3. Erosion in millimeters from the exterior surface occurs in areas 18 (FIG. 1) closest to the tip where velocity is highest. The amount of erosion increases with velocity. The abscissa of the plot of FIG. 3 shows maximum erosion near the maximum radial length (i.e., near the tip) of the blade. This follows because the velocity is a function of the speed of rotation and the radial distance from the axis of rotation.

Erosion results from sliding of the particles over a region near the leading edge and is maximum where the velocity is highest. Erosion also occurs near the leading edge due to impact of the particles in the flow stream at 23 in FIG. 2. The impacts are principally along the pressure surface of the leading edge, (especially at 10° angle of attack as shown in FIG. 2); the blade chord being tilted upwardly to provide the requisite angle of attack. The leading edge sliding erosion appears as a wedge 21 which is more prominent on the suction side near the tip 12. It is the leading edge where erosion begins. Once the leading edge region erodes, erosion propagates along the blade forming vortex grooves 20 which grow into the erosion areas 18 through the skins of the impeller. Then the impeller flow pattern is severely distorted and it must be repaired or replaced. The erosion at the tip is also enhanced by the flow around the tip between the pressure and suction surfaces 12 and 14. This tip vortex erosion further reduces the life of the blades. Typically, the erosion flattens or wedges the leading edge as shown in FIG. 2. After the leading edge becomes flat, the flow separates and commences to erode the suction surface in the region near the leading edge. The eroded areas grow until the blade is penetrated.

Heretofore, erosion has been resisted by coatings or bodies of hard material which withstand the effect of the particles (see U.S. Pat. Nos. 4,318,672, issued Mar. 9, 1982, U.S. Pat. No. 4,808,055, issued Feb. 28, 1989, U.S. Pat. No. 5,033,938, issued Jul. 23, 1991) and also compliant protective coatings have been suggested. See U.S. Pat. No. 4,571,090, issued Feb. 18, 1986, and U.S. Pat. No. 5,123,814, issued Jun. 23, 1992. It has also been proposed to confine the tips of the impeller in the way of a draft tube in order control flow and reduce erosion. See U.S. Pat. No. 4,802,771, issued Feb. 7, 1989.

While erosion resistant coatings extend the life of the blades, they must be relatively thin and are also subject to chipping and marring, which creates discontinuities in the flow which may produce further erosion. Thus, protective coatings alone do not extend the life of the impeller. A conventional impeller used in a solid suspension environment containing erosion producing crystallites may have a life time of four years. It is desirable that the life be extended by at least four years (doubled). It is also desirable to improve efficiency of operation of the mixing system. This entails increasing the flow velocity.

This invention is based upon the realization that the erosion is greatest in the region near the leading edge and that a complex of measures is necessary to obtain the requisite extended life of the impeller. The invention provides such extended life by utilizing a configuration of plates to form the impeller blades which enables the thickness of the blades to be increased. The leading edge region is covered by a layer of erosion resistant or protective material. The shape of the blade maintains a lower velocity, by moving the maximum velocity away from the leading edge which is prone to erosion. Discontinuities, especially near the leading edge, which form vortices, are avoided by providing a continuous surface without discontinuities in the erosion prone leading edge of the blades. The life of the blades can be further reduced by counteracting tip vortex erosion by means of fins which counteract the formation of tip vortices.

Accordingly, it is the principal object of the invention to provide an improved erosion resistant mixing impeller.

It is a still further object of the invention to provide an improved erosion resistant impeller constructed of plates arranged to provide airfoils, but which may be sufficiently thick to withstand the erosion produced over a desired blade lifetime.

It is a still further object of the invention to provide an improved erosion resistant impeller with camber which is maximum, not near the leading edge, but away from the leading edge, and preferably midway of the blade between the leading and trailing edge thereof.

It is a still further object of the invention to provide an improved erosion resistance impeller wherein discontinuities giving rise to erosion enhancing vortices are avoided, especially near the leading edge and tips of the blades.

Briefly described, an erosion-resistant impeller embodying the invention has blades with opposite sides having external surfaces which provide the pressure and suction surfaces of the blade. The blade is oriented to produce flow of material being circulated by the impeller which causes erosion principally near the leading edge by sliding material as it flows over the suction surface of the blade and by impact as the particles of the material impinges on the pressure surface. Each blade is formed from a first or suction side plate and a second or pressure side plate. The suction side plate has greater curvature than the pressure side plate and overlaps the pressure side plate near the edges thereof to form the leading and trailing edges of the impeller. The overlapping relationship of the plates enables the plates to be as thick as necessary to provide the life time required for the application. The blades are connected as by welds along notches between the overlapped edge of the second plate and the underside of the first plate. The leading edge area may be covered with an erosion resistant material. This material may be a tougher material than the blade material itself, or may be a compliant material. For high temperature application tough ceramics or metals may be used. Elastomeric materials may be used where the temperature of the material being mixed does not drastically affect (causes failure of) the elastomeric characteristics of the material. Neither the coating nor the plates are discontinuous along the suction surface where sliding erosion occurs and flow velocity is highest. Flow velocity is also reduced by increasing the curvature towards the middle of the pressure surface, thereby providing greatest camber approximately midway between the leading and trailing edges and reducing the velocity at the leading edge, which is prone to the greatest erosion; thus increasing impeller life time-by reducing the erosion near the region of the leading edge along the suction side of the blade. The complex of characteristics, namely increased blade thickness, protective coating on the leading region, avoidance of discontinuities and if desired, shaping the curvatures to provide maximum velocity midway of the blade, all lead to enhanced life time in erosion prone environments.

In addition, the invention provides a hub arrangement for the impeller on which the blades are mounted which may be bolted together for ease of construction and blade replacement.

The foregoing and other objects, features and advantages of the invention, and the presently preferred embodiments thereof will become more apparent from a reading of the following description in connection with the accompanying drawings in which.

Figure 1:
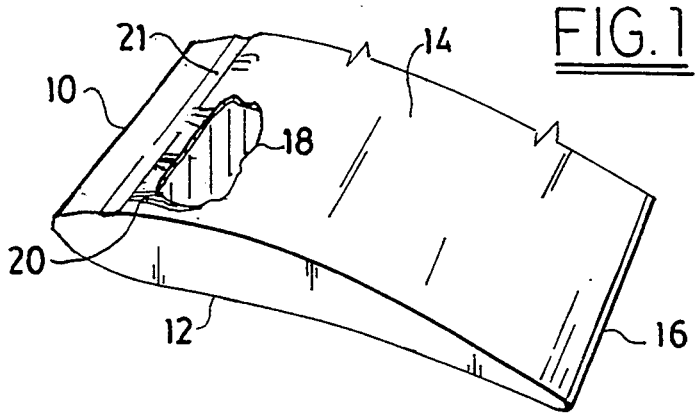
FIG. 1 is a perspective view of a conventional airfoil blade showing the development of erosion initially near the leading edge as discovered in accordance the invention.
Figure 2:
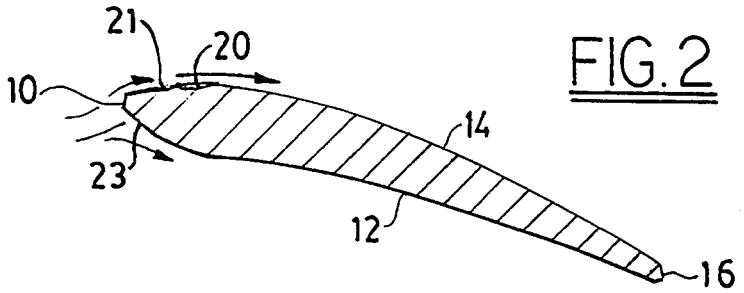
FIG. 2 is an end view showing the tip of the blade illustrated in FIG. 1 and flow lines indicating sliding erosion and impact erosion on the suction and pressure surfaces (respectively) near the leading edge.
Figure 3:
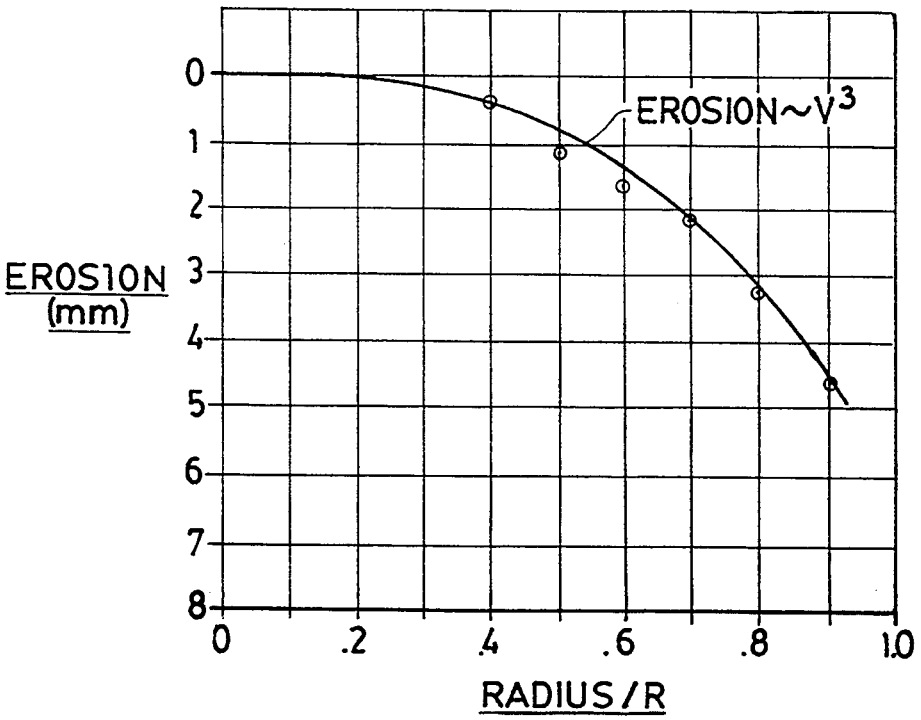
FIG. 3 is a plot showing that erosion varies with the cube of the velocity of the blade.
Figure 4:
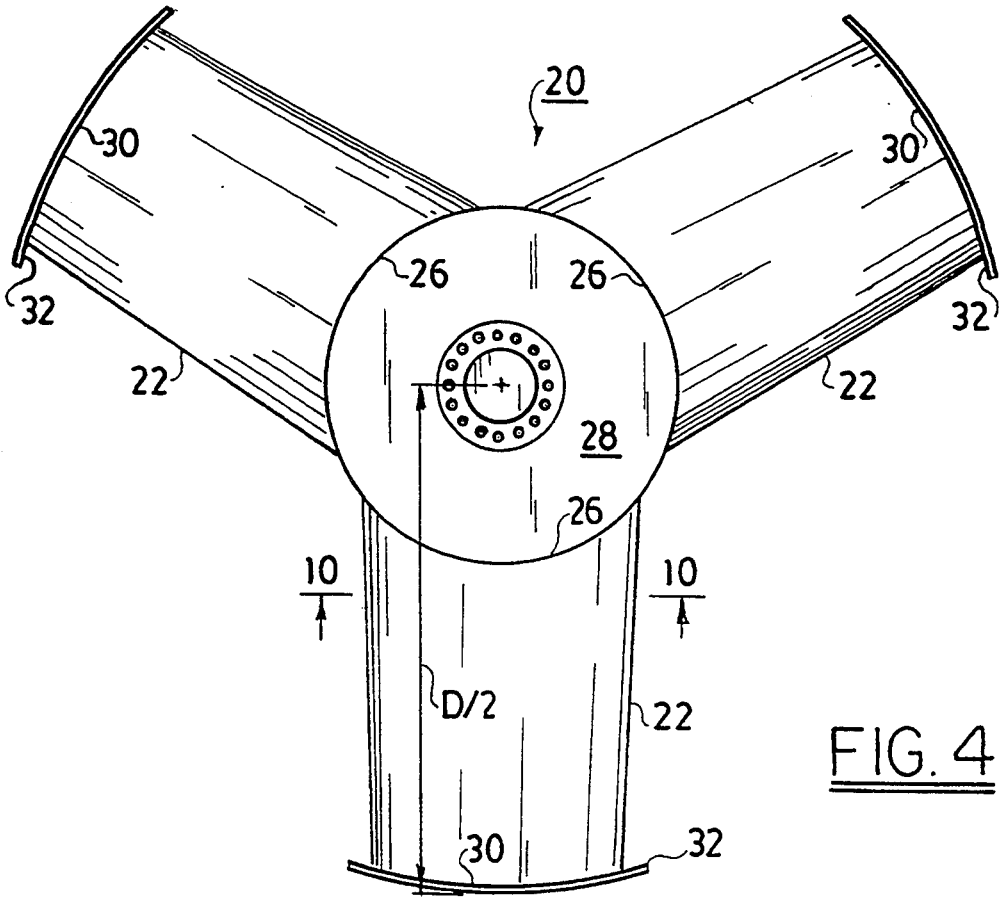
FIG. 4 is a plan view of an impeller embodying the invention.

FIGS. 1 to 3 were discussed above and present the causes of impeller blade erosion and bases of the improvements provided by the invention to resist erosion and extend the life of the impeller. FIGS. 4, 5, 10 and 11 illustrate an impeller 20 which embodies these improvements. The impeller has a plurality of blades, 22. Three such blades 120° apart about the axis of rotation 24 of the impeller, are shown in this illustrative embodiment. The invention accommodates one or more blades as may be required by the mixing application. These blades are airfoils having camber and twist. They are attached, as by welding along the bases 26 thereof, to a cylindrical hub 28. The impeller has fins 32 which are curved quadrangular plates attached, as by welding, at the tips. The diameter of the impeller as measured about the axis of rotation 24 to the outside dimension of the fin 32 is D. Each impeller extends from the axis to its tip a radial distance D/2. The impeller is driven by a drive shaft 34 connected via a flange 36 to a drive shaft extension which in turn is connected to a motor driven gear box. The motor, gear box and extension are of conventional design and are not shown in the accompanying drawings. The impeller may be an open impeller, but for an application in which the impeller suspends solids (particles) in a slurry in order to facilitate a reaction where crystallites are grown, as in the process of making alumina in aluminum production, it is desirable that the impeller run in the way 34 of a draft tube 36, partially shown in FIG. 5. The tips 30 as well as the fins 32 are curved so that they can rotate within the way of the draft tube 36. Fins provide for more efficient pumping and also counteract the formation of tip vortices, thereby reducing erosion at the tips.

Figure 6:
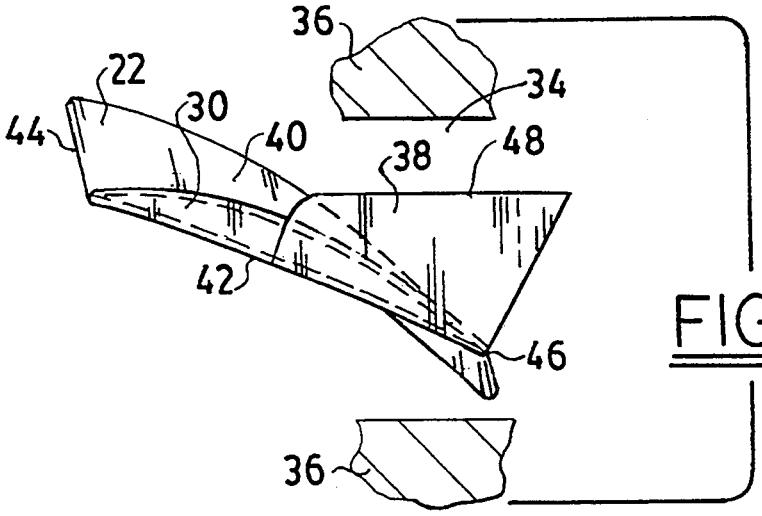
FIG. 6 is an end view of a blade illustrating a fin or proplet located at the tip and extending above the suction surface between the trailing edge and a point midway between the trailing and leading edge of the blade.

FIG. 6 shows a fin 38 which is attached to the tip 30 of a blade 22. The blades have opposite sides 40 and 42. The exterior surface of the side 40 has greater curvature than the side 42 and defines a surface over which the flow produced by the impeller has greatest velocity. The surface 40 is therefore the suction surface of the blade, The surface of the other side 42 is the pressure surface of the blade. The fin 38 extends above only the suction surface 40 and from a location on the blade midway between its leading and trailing edges 44 and 46. The upper edge 48 of the blade is approximately tangent to the suction surface at the tip 30. This fin construction has the advantage of being smaller than the quadrangular fin 32 and is more efficient in terms of pumping than the larger fin.

Figure 10:
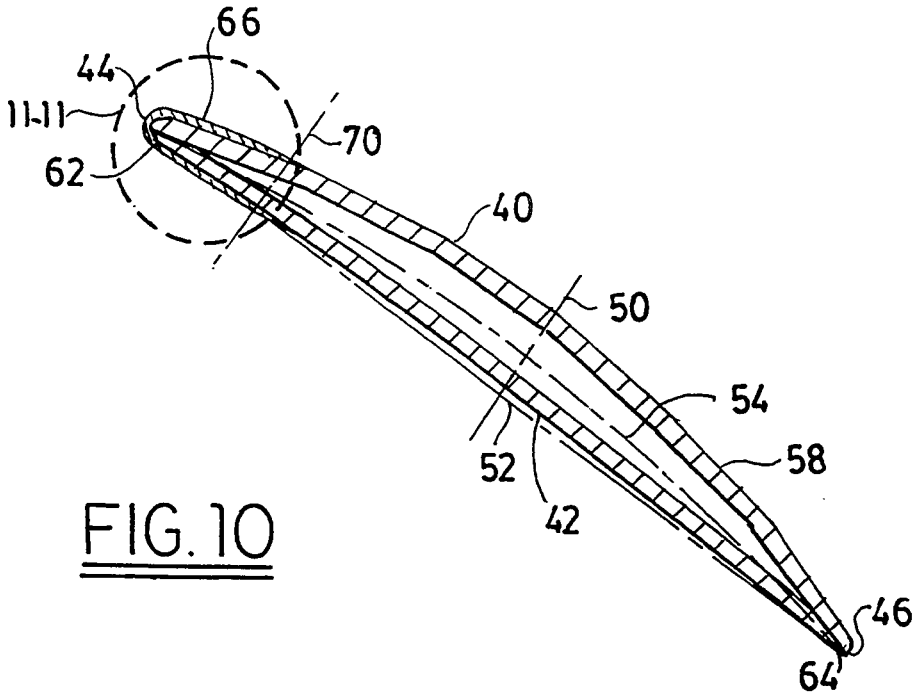
FIG. 10 is a sectional view of one of the blades of the impeller shown in FIGS. 4 and 5 taken along the line 10—10 in FIG. 4.
Figure 11:
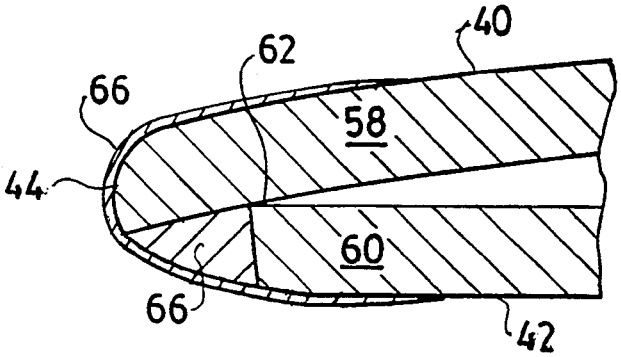
FIG. 11 is an enlarged view of a portion of FIG. 10 within the circle 11—11 on FIG. 10.
Figure 12:
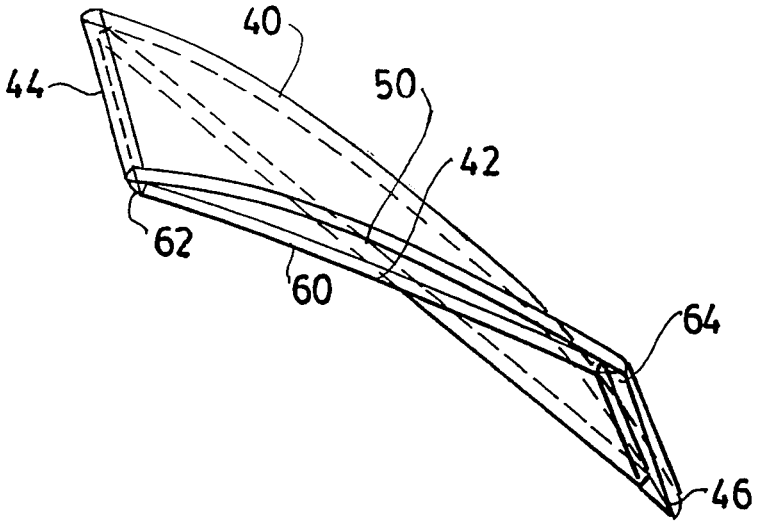
FIG. 12 is a perspective view illustrating the blade shown in FIGS. 4, 5, 10 and 11 in the process of construction.

FIG. 10 illustrates a cross section of the blade at 0.4 D/2. FIG. 10 and also FIGS. 11 and 12 illustrate how each blade is constructed in order to make the sides of the blade as thick as necessary to provide the life time (before penetration by erosion) sufficiently long to meet the specifications for the mixing application. These figures also show a shape of the airfoil which transfers maximum camber, to approximately the midway position of the blade so as to relieve the leading edge region which is prone to erosion from impact of the material being circulated away from the leading edge thereby further extending the life of the blade by reducing the maximum flow velocity near the leading edge of the blade. The midway point is illustrated by the line 50 made up of long and short dashes.

The blade has a chord 52 and a meanline 54. The chord extends between the leading and trailing edges 44 and 46, while the midline bisects the distance between the pressure and suction surfaces 40 and 42.

The angle of the blade is defined as the angle between the chord and a plane perpendicular to the axis of rotation, which, for example, may intersect the chord. The tip chord angle (TCA) is the angle between the chord and the plane at the tip. The TCA in a preferred embodiment is 21° but may vary from about 10° to 25°. The angle between the chord and the plane at the base may be 37° thereby providing a twist of 16°, but may range from 12° to 17°. The twist between the tip and hub is defined as the difference in the chord angles at these respective locations. At 0.4 D/2 the chord to plane angle is 35° and at 0.3 D/2 that angle is 37°. The width of the blade increases between the tip and the hub in a presently preferred embodiment and may, for example, be such that the chord length is 0.36 D/2 at the tip (but may vary from about 0.3 to 0.5 D/2) and linearly increases to about 0.499 D/2 chord length at 0.3 D/2 (but may vary from about 0.4 to 0.6 D/2). The blade also has a thickness which is measured at the maximum altitude or height between the suction and pressure surfaces. This maximum thickness is at the midway line 50 and is approximately 0.05 D/2, or about 10% of chord length. The camber is measured between the chord 52 and the meanline 54 at the line of maximum thickness. In a preferred embodiment, the camber is about five percent (5%) of the chord length. The airfoil, therefore, is similar to a NACA 5510 type airfoil.

In order to enable the thickness of the sides of the impeller to satisfy specifications for life of the blade, the blade is made up of a first or suction side plate 58 and a second or pressure side plate 60. The first plate 58 is curved. The second plate 60 has a slight curvature. The curved plate 58 is longer in width than the plate 60 and defines a nest in which the blade 60 is located. The edges of the plate 58 are radiused or machined to a desired shape to the exterior surface 40 to define the leading and trailing edges of the blade 44 and 46. The edges of the blade 60 are quadrangular, thereby defining wedge shaped notches 62 at the leading edge 44 and 64 at the trailing edge 46.

The plates are assembled by welds which fill the notches 62 and 64 and are ground to provide a curved surface at the leading edge 44 and also to provide a plane which is tangent to the pressure surface at the trailing edge 46. The weld 66, at the leading edge, is best shown in FIG. 11. How the plates 58 and 60 are assembled together after they are shaped is best shown in FIG. 12. It will therefore be apparent that the plates 58 and 60 may be as thick as required to withstand penetration due to erosion.

The blades themselves need not be made of exotic materials, but may be cold rolled steel. This enables the cost of the impeller to be minimized over the cost of an impeller where the blades were made from exotic materials such as stainless or high alloy (using a combination of alloys) steels. It will be appreciated, of course, that where the impellers must operate in environments which are highly corrosive to steel, other materials can be used.

It has been found that the region at the leading edge 44 backwards towards the trailing edge 46 along the pressure and suction surfaces 42 and 40 which is highly prone to erosion, is approximately 14 percent of the chord length, (but may vary from 10 to 20% of the chord length) i.e., the distance between the leading edge to a line 70 back from the leading edge is where erosion occurs. This is particularly the case for sliding erosion, where the angle of attack of the blade is maximized for greatest flow velocity. This angle of attack may, for example, be approximately 12°. The angle of attack is the angle between the chord and the vector of flow velocity. In this region, which is prone to erosion, the pressure and suction surfaces 42 and 40 have applied thereto a layer 66 of erosion resistant material. A presently preferable material is chrome oxide. It may be applied by flame spraying. The material is only about 1 mm thick and is shown exaggerated in size in the drawings. The material is harder and tougher than the steel of the plates 58 and 60. In order to avoid vortices which can provide locally high velocity flow on the surfaces in the leading edge region where the flow velocity is high, particularly over the suction surface 40, the plate 58 is made continuous in this region. Also the layer 66 is continuous and feathers inwardly so as to gradually meet the suction and pressure surfaces 40 and 42. It is a feature of the invention to avoid discontinuities by providing continuous surfaces at least in the region of the blade where it is erosion prone. It is unnecessary to cover the entire blade outer surface with erosion resistant material, thereby reducing the cost of the impeller about—half over the cost of entirely coated blades.

An elastomeric material such as soft urethane or ultra high molecular weight polyethylene (UHMW) or rubber may be used to provide the layer 66. Such material is compliant and damps impacting particles so as to reduce erosion due to high velocity particles. In the event an elastomeric material such as rubber is used, it may be wrapped and bonded over the entire surfaces 40 and 42 of the blades.

Figure 5:
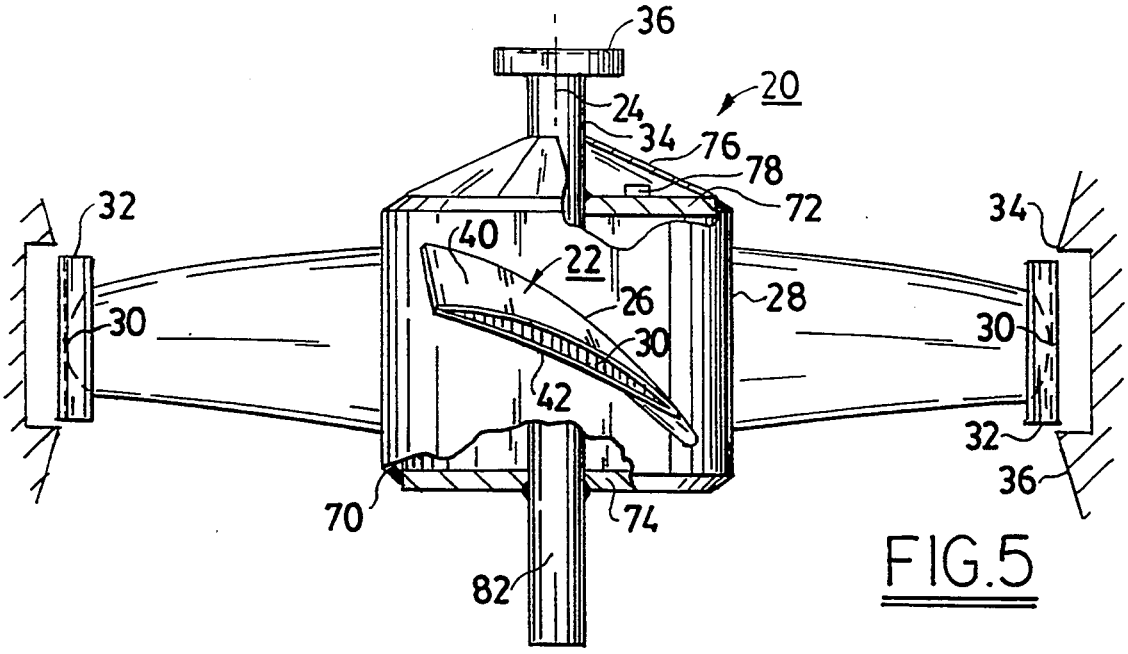
FIG. 5 is an elevational view of the impeller shown in FIG. 4 which is partially broken away to illustrate the internal construction at the hub and also to show the way of a draft tube in which the impeller may operate.

Referring to FIG. 5, there is shown one hub construction. The hub body is hollow and is provided by a cylinder 70 to which end plates 72 and 74 are welded. A conical section 76 provides a cap which is connected as by welding to the top end plate 72 and the cylinder 70. The end plate 72 and 74 are welded to the shaft 34. Balancing weights may be used to balance the impeller assembly. One such weight is shown at 78. The blades 22 are welded to the cylindrical hub body. A stub section 82 extends below the bottom plate 74 and runs within a collar (not shown) which assures that the impeller does not move off center by an amount greater the lateral clearance gap 84 in the way 34 of the draft tube 36.

Figure 8:
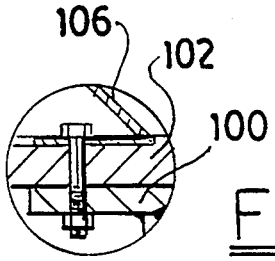
FIG. 8 is an enlarged view showing one of the bolts, the view being taken within the circle labeled 8—8 in FIG. 7.
Figure 7:
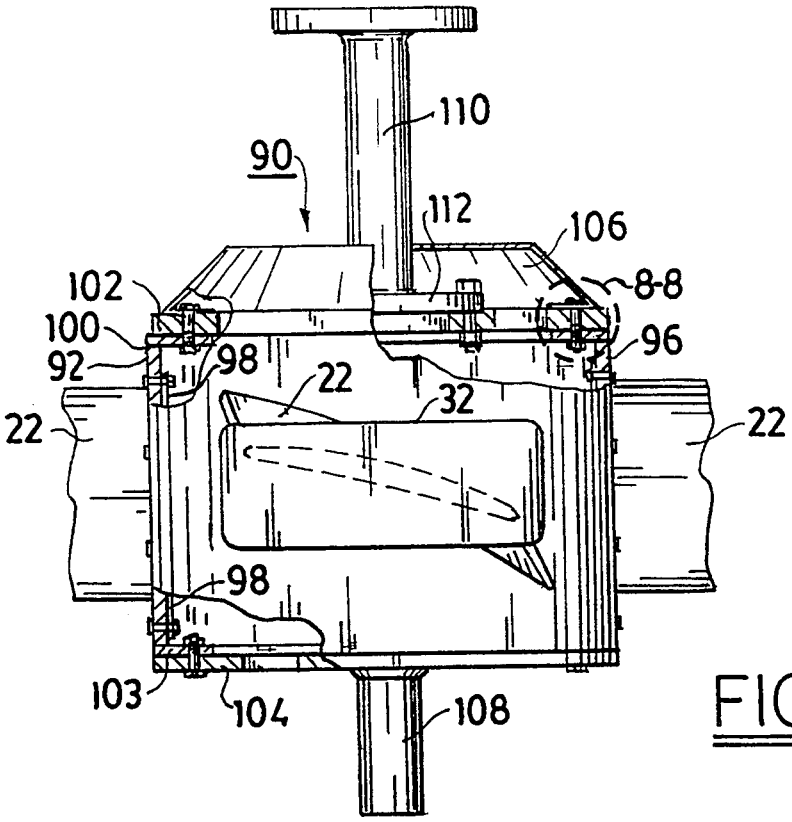
FIG. 7 is an elevational view of an impeller embodying the invention which has a bolted together hub in accordance with another embodiment of the invention.
Figure 9:
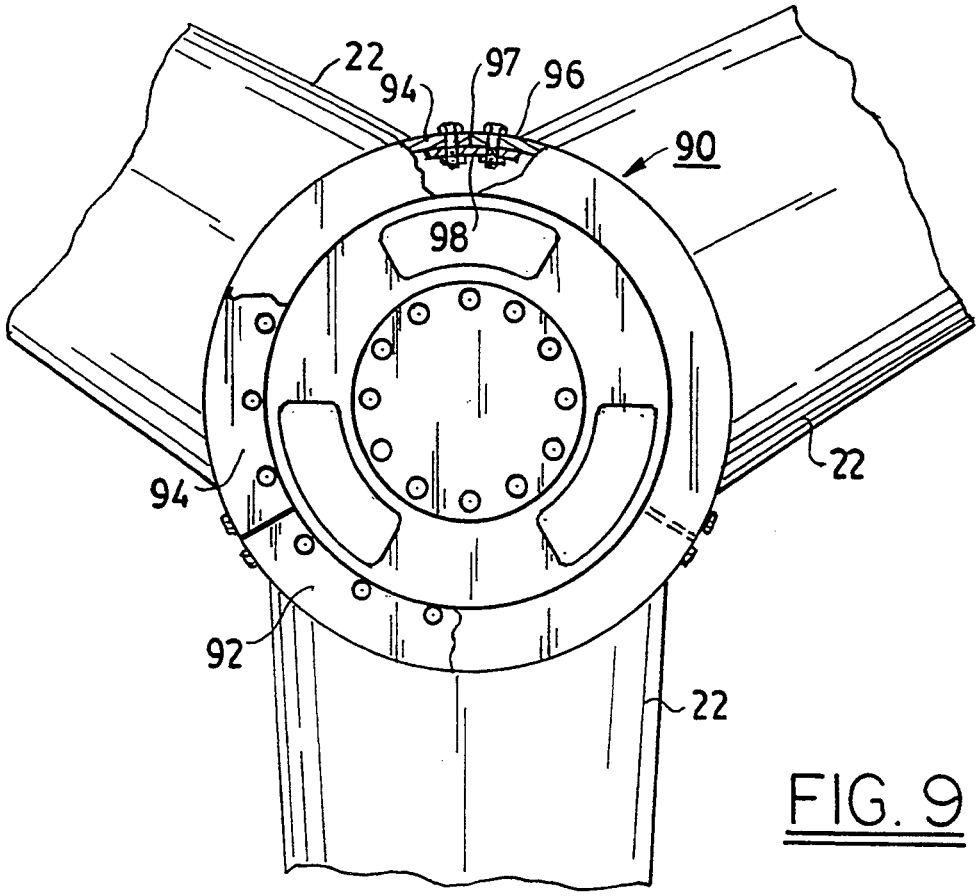
FIG. 9 is a fragmentary plan view of the impeller shown in FIGS. 7 and 8.

A bolted together hub structure 90 is illustrated in FIGS. 7, 8 and 9. The hub body is assembled from three 120° cylindrical segments 92, 94 and 96. These segments abut along their edges 97 and are bolted to internal plates 98. Disk-shaped rings 100 and 103 are welded along their peripheral edges to the ends of the segments 92, 94 and 96 after they are bolted to end plates 102 and 104. The top end plate 102 is a drive support plate. It may have a conical cap 106 bolted to it and to the ring 100. The lower end plate 104 may have a stub shaft 108 for centering purposes. The drive shaft 110 has a lower flange 112 which is bolted to the top end or drive support plate 102.

In fabricating the hub, the rings 100 and 103 may be welded after they are bolted to the end plates 102 and 104. Then the end plates may be unbolted and the faces of the rings and the end plates which are bolted together may be machined so that any deviation from flatness may be removed. Then, these plates and rings are rebolted.

The blades 22 are assembled each on a different one of the segments 92, 94 and 96 by welding using simple fixturing to hold the blades in position.

From the foregoing description it will be apparent that there has been provided an improved mixing impeller with blades which are erosion resistant and may be fabricated to provide the requisite or specified life time in an erosion-producing environment. Variations and modifications in the herein described impeller, within the scope of the invention, will undoubtedly suggest themselves to those skilled in the art. Accordingly, the foregoing description should be taken as illustrative and not in a limiting sense.

We claim:

1. In an impeller having an airfoil blade with opposite sides having external surfaces which provide pressure and suction surfaces of said blade, said blade having leading and trailing edges and extending radially of said impeller from an axis of rotation of said impeller between a tip at an outer end thereof and a base at an inner end thereof, said blade being oriented to produce flow of material which causes erosion principally near the leading edge thereof by sliding of the material as it flows over the suction surface and impact with the pressure surface, the improvement which comprises a first plate and a second plate which are disposed in overlapping relationship and respectively define the suction and pressure surfaces of said blade on exterior sides thereof, said exterior sides extending to interior sides over a thickness which extends the life of said blade in the presence of erosion, an edge of said first plate defining the leading edge of said blade and extending continuously toward the trailing edge covering a distance and area where erosion by sliding of the material principally occurs, said second plate having an edge which contacts the interior surface of said first plate near said edge of said first plate where said blade is subject to erosion by impact, and a layer of erosion resistant material around said leading edge of said blade over the edge of said first plate which defines said leading edge and the edge of said second plate and extending toward said trailing edge over an area of a region of sufficient size at least where erosion by sliding and by impact principally occurs thereby further extending the life of said blade in the presence of erosion, wherein said airfoil blade has a chord between the leading and trailing edges thereof, said airfoil blade having camber and defining a location behind said leading edge where said camber is maximized at a distance about 50% of the length of said chord from said leading edge.

2. The improvement according to claim 1 wherein said first plate overlaps said second plate along said leading edge to define a notch between edges of said plates, a body of material assembling said plates together in said notch.

3. The improvement according to claim 1 wherein said blade extends radially from said axis from the base to the tip, the radial distance from said axis to said tip being half the diameter D of said impeller, and said plates each having a thickness between exterior side surfaces and interior side surfaces thereof up to 0.05 D/2 and which thickness is sufficient to avoid penetration due to said erosion over the lifetime of said impeller.

4. The improvement according to claim 1 wherein said airfoil blade has a chord length between the leading and trailing edges thereof and said layer extends from said leading edge toward said trailing edge a distance of from about 10 to 20% of said chord length (CL).

5. The improvement according to claim 1 wherein said blade has a thickness of about 10 percent of the CL at a location where said blade has a maximum height H between the exterior surfaces of said plates.

6. The improvement according to claim 5 wherein said blade has twist which varies over an angle of from about 12° to 17°.

7. The improvement according to claim 6 wherein the angle between the chord and the plane at the tip (TCA) from about 10° to 25°.

8. The improvement according to claim 1 wherein said plates are cold rolled steel and said erosion resistant material is much harder than cold rolled steel.

9. The improvement according to claim 8 wherein said erosion resistant material is chrome oxide.

10. The improvement according to claim 1 wherein said erosion resistant material is elastomeric material.

11. The improvement according to claim 10 wherein said elastomeric material is selected from the group consisting of ultra high molecular weight polyethylene (UHMW), rubber, and urethane.

12. The improvement according to claim 1 wherein said impeller has a cylindrical hub comprising a plurality of segments having edges along said axis and being assembled with said edges in abutting relationship, said segments having opposite ends, first and second annular rings extending from said ends inwardly toward said axis, a drive support plate, a drive shaft having a flange assembled therewith, said first annular ring being bolted to said drive support plate, said drive support plate being bolted to said flange, a second plate bolted to said second annular ring, said blades each having a base extending to the tip thereof, each said base being curved complementary to the curvature of said segments, and each said blade being attached at the base thereof to a different one of said segments.

13. The improvement according to claim 1 further comprising a fin disposed at the tip of said blade for decreasing flow of said material around the tip between the pressure and suction surfaces and thereby further reducing erosion at and in the vicinity of said tip.

14. The improvement according to claim 13 wherein said fin is disposed on only one side of said blade and extends above said suction surface from about midway of said suction surface between said leading and trailing edges to at least said trailing edge.

15. In a mixing system wherein a slurry is circulated by an impeller having a plurality of blades subject to erosion as they rotate about an axis, the improvement for extending the life of said impeller characterized in that each said blade of said plurality of blades comprises a first plate and a second plate, said first plate having an exterior surface which defines the suction surface of said blade, said second plate having an exterior surface which defines the pressure surface of said blade, said first plate having an edge which defines the leading edge of said blade, said first plate extending continuously toward an edge of said first plate which defines the trailing edge of said blade at least a distance toward the trailing edge over the region where said first plate is subject to sliding erosion, said first plate having greater curvature than said second plate to define a nest in which said second plate is disposed with said first plate overlapping and second plate along said leading edge to define a wedge shaped notch along and behind said leading edge, said notch being filled with material which assembles said plates together, and a layer of erosion resistant material more resistant to erosion than said plates on exterior surfaces of said first and second plates and said material in said notch over at least said distance behind said leading edge to cover said region on said suction surface and another region on said pressure surface of area commensurate with said first named region on said suction surface, wherein said blade is an airfoil having a chord between the leading and trailing edges thereof, said airfoil having camber and defining a location behind said leading edge where the camber is maximized at a distance about 50% of the length of said chord from said leading edge.

16. The improvement according to claim 15 wherein said first plate overlaps said second plate along said trailing edge to define another notch between edges of said plates, a body of material assembling said plates together in said another notch.

17. The improvement according to claim 15 wherein said blade extends radially from said axis from the base to the tip, the radial distance from said axis to said tip being half the diameter D of said impeller, and said plates each having a thickness between exterior surfaces thereof and interior surfaces thereof up to 0.05 D/2 and which thickness is sufficient to avoid penetration due to aid erosion over the lifetime of said impeller.

18. The improvement according to claim 17 wherein said airfoil blade has a chord length, CL, between the leading and trailing edges thereof and said distance over which said layer extends being from 10%–20% of said chord length.

19. The improvement according to claim 18 wherein said blade has a thickness of about 10 percent CL at a location where said blade has a height H between the exterior surfaces of said plates which is maximum.

20. The improvement according to claim 19 wherein said blade has a twist which varies over an angle of about 12° to 17°.

21. The improvement according to claim 20 wherein the angle between the chord and the plane at the tip (TCA) is about 10° to 25°.

22. The improvement according to claim 15 wherein said plates are cold rolled steel and said erosion resistant material is much harder than cold rolled steel.

23. The improvement according to claim 22 wherein said erosion resistant material is chrome oxide.

24. The improvement according to claim 15 wherein said erosion resistant material is elastomeric material.

25. The improvement according to claim 24 wherein said elastomeric material is selected from the group consisting of ultra high molecular weight polyethylene (UHMW), rubber, and urethane.

26. The improvement according to claim 15, wherein said impeller has a cylindrical hub comprising a plurality of segments having edges along said axis and being assembled with said edges in abutting relationship, said segments having opposite ends, first and second annular rings extending from said ends inwardly toward said axis, a drive shaft having a flange assembled therewith, a drive support plate, said flange being bolted to said drive support plate, a second plate bolted to said second annular ring, said blades each having a base extended to the tip thereof, each said base being curved complementary to the curvature of said segments, and each said blade being attached at the base thereof to a different one of said segments.

* * * * *